US006035686A

United States Patent [19]

Muhr et al.

[11] Patent Number: 6,035,686

[45] Date of Patent: Mar. 14, 2000

[54] METHOD AND INSTALLATION FOR PRODUCING BICONICAL WIRE

[75] Inventors: Thomas Muhr, Attendorn; Andreas Kleemann, Weissensee; Hartmut Saljé, Erfurt, all of Germany; Tesukazu Fukuhara; Takao Yamazaki, both of Shinagawa-ku, Japan

[73] Assignees: Muhr und Bender, Attendorn, Germany; Neturen Co., Ltd., Tokyo, Japan

[21] Appl. No.: 09/162,228

[22] Filed: Sep. 29, 1998

[30] Foreign Application Priority Data

| | | | |
|---|---|---|---|
| Sep. 30, 1997 | [DE] | Germany | 197 43 034 |
| Jan. 7, 1998 | [DE] | Germany | 198 00 237 |

[51] Int. Cl.[7] ..... B21B 31/07; B21B 27/06; B21B 31/20

[52] U.S. Cl. ..... 72/240; 72/200

[58] Field of Search ..... 72/240, 248, 200, 72/201, 202, 224, 225, 234, 235, 365.2, 366.2

[56] References Cited

U.S. PATENT DOCUMENTS

| | | | |
|---|---|---|---|
| 5,058,410 | 10/1991 | Losch et al. | 72/201 |
| 5,331,835 | 7/1994 | Palma et al. | 72/224 |
| 5,832,765 | 10/1998 | Ohashi | 72/235 |

FOREIGN PATENT DOCUMENTS

| | | |
|---|---|---|
| 41 29 172 | 3/1993 | Germany . |
| 42 33 462 | 4/1994 | Germany . |
| 196 04 408 | 5/1997 | Germany . |

OTHER PUBLICATIONS

Enzyklopädie Naturwissenschaft und Technik, Bd. 5 Str–Z, 1981, Verlag Moderne Industrie, Wolfgang Dummer 7 Co., 8910 Landsberg A. Lech, Germany, pp. 4933–4938.

Lueger Lexikon Der Technik, Band 5, Lexikon Der Hüttentechnik, Deutsche Verlags–Anstalt Stuttgart, 1963, Hans Grothe, pp. 129–133 and pp. 703–704.

*Primary Examiner*—Rodney Butler

*Attorney, Agent, or Firm*—Sixbey, Friedman, Leedom & Ferguson; David S. Safran

[57] ABSTRACT

A method and an installation for producing biconical wire, i.e., wire with repeating cylindrical and conical wire sections from a cylindrical starting material, in particular for producing helical compression springs inexpensively by using hot forming to form the conical wire sections. The installation has a heating unit (1) and a forming unit (2). The embodiment also includes a cooling unit (3) downstream from the heating unit (1), a cooling unit (4) downstream from the forming unit (2), a roll control (5), a re-rolling unit (6) downstream from the forming unit (2), another heating unit (7) for annealing or tempering, a cooling unit (8) downstream from the additional heating unit (7), an uncoiler (9), a roller straightening apparatus (10) and a coiler (11).

27 Claims, 3 Drawing Sheets

METHOD AND INSTALLATION FOR PRODUCING BICONICAL WIRE

BACKGROUND OF THE INVENTION

1. Field of the Invention

The invention relates to a method and installation for producing biconical wire, i.e., wire having repeating cylindrical wire sections, on the one hand, and conical wire sections, on the other hand, from a cylindrical starting material, especially for production of helical compression springs.

2. Description of Related Art

In automotive engineering, helical compression springs are used extensively as axial springs. The prevailing trend in automotive engineering toward minimizing the weight of the automobile has increasingly resulted in suppliers being confronted with the demand that individual components must be designed as lightweight as possible—with a given function and lifetime. With helical compression springs used as axial springs, this has led to the use of high-strength wires with a tensile strength of 2000 MPa or more. Furthermore, weight savings can be achieved with helical compression springs that are used as axial springs by using biconical wire to produce them, i.e., wire with repeating cylindrical wire and conical wire sections (see, published unexamined German Patent Applications Nos. 41 29 172 and 42 33 462 as well as German Patent No. 196 04 408). Moreover, special spring characteristics can be achieved by using biconical wire for production of helical compression springs (see, column 1, lines 26 through 36 of published unexamined German Patent Application No. 41 29 172). Further more a minimization of the required fitting space for the corresponding helical compression spring can be realized.

Whenever biconical wire has been used, so far, to produce helical compression springs, the biconical wire has been produced by a process of paring from wire with a constant diameter, i.e., from a cylindrical starting material. On the one hand, this is relatively expensive from a production standpoint; in addition to the cost of materials and personnel costs, there is also the additional cost of materials due to material losses. On the other hand, the paring operation causes striations or scratches on the surface of the wire; such paring striations or scratches can lead to a local increase in stress, and consequently, to a reduced lifetime, or at least a greater range of scattering in lifetimes.

Moreover, in conjunction with improving the properties of martensitic wires for production of helical compression springs by cold rolling, it is also known (see published unexamined German Patent Application No. 42 33 462, column 9, lines 25 through 43, FIGS. 6*a* and 6*b*) that a rotating, program-controlled cold rolling device may be provided for forming the martensitic wire to an inconstant diameter after cutting to predetermined lengths, thus yielding inconstant resistance moments. However, this is the state of the art only on paper as it has not led to a biconical wire suitable for production of helical compression springs.

SUMMARY OF THE INVENTION

Consequently, a primary object of this invention is to provide a method of the initially mentioned type with which it will be possible to make high-strength biconical wires that can readily be used for production of helical compression springs, in particular as axial springs for automotive engineering.

The method according to this invention is characterized first and foremost in that the conical wire segments are produced by hot forming. This permits the use of rolled or bent wire as the starting material, or a starting material can be used which has a tensile strength of 2000 MPa or higher, which is especially important. In particular, a CrSi-alloyed wire such as 54SiCr6 and 60SiCrV6 or steels with similar chemical composition like SUP 12 or SAE 9254 can be used as the starting material.

In the method according to this invention, the forming is preferably accomplished through rolls that can be advanced toward each other in operation so that the roll gap, and thus the dimensions of the rolling stock, can be varied in operation.

The advantages achieved by the method according to this invention can be summarized by the fact that the method according to this invention is less expensive than the previous paring method and that paring striations or scratches and the disadvantages associated with them are, of course, avoided.

A further object of the invention is to provide an installation for the production of biconical wire, which is comprised of at least a heating unit and a forming unit. Specifically, there are various possibilities for embodying and refining the method and installation according to this invention.

These and further objects, features and advantages of the present invention will become apparent from the following description when taken in connection with the accompanying drawings which, for purposes of illustration only, show a single embodiment in accordance with the present invention.

DETAILED DESCRIPTION OF THE INVENTION

Figure 1:
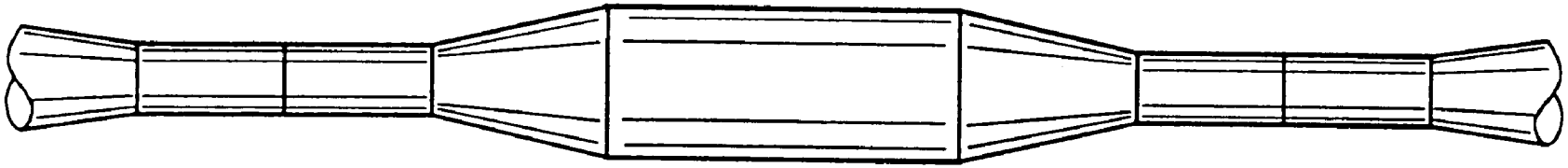
FIG. 1 shows a segment of a biconical wire of the type which the present invention is directed toward producing.
Figure 2:
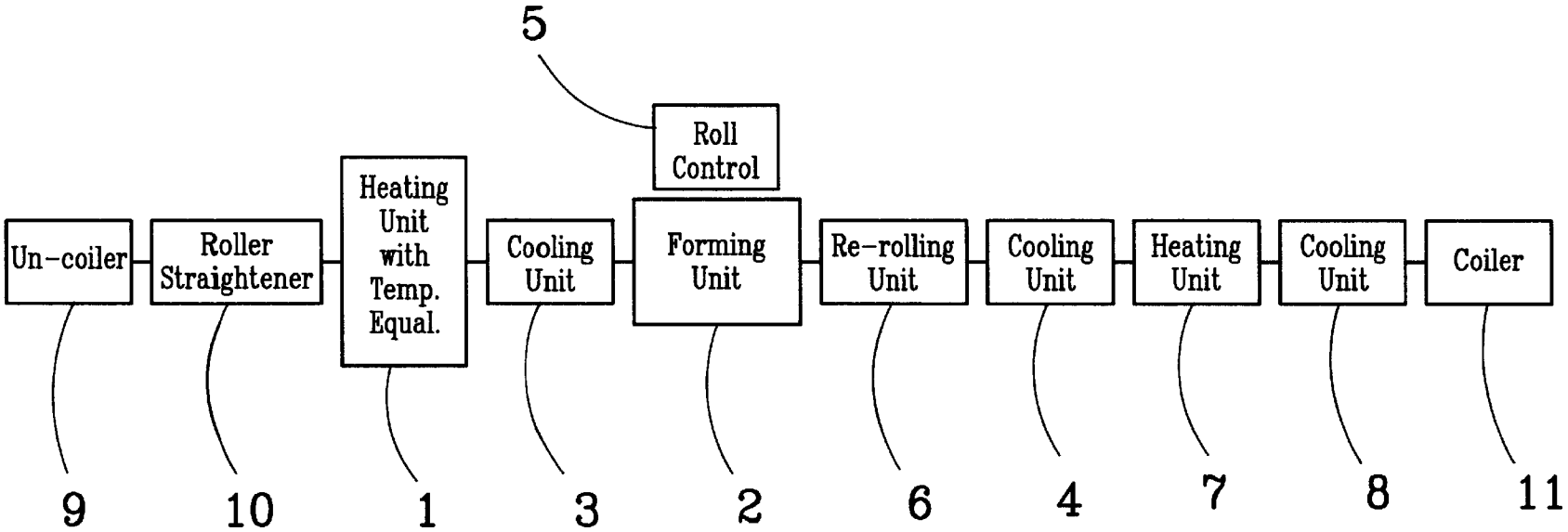
FIG. 2 is a block diagram representing a method and installation in accordance with the present invention; and FIG, 3. is a view similar to that of FIG. 2, but showing a modified embodiment.

The installation diagramed in the FIG. 2 is for manufacturing biconical wire, i.e., wire with repeating cylindrical wire sections, on the one hand, and conical wire sections, on the other hand, from a cylindrical starting material, and in particular, for the production of helical compression springs such as those used especially as axial springs in automotive applications. The biconical wire shown in FIG. 1 is known, per se, in which regard reference is made in particular to FIGS. 1 and 2 of published unexamined German Patent Application No. 41 29 172, to FIGS. 6*a* and 6*b* of published unexamined German Patent Application No. 42 33 462 and to FIG. 1 of German Patent No. 196 04 408.

The installation, which is only diagramed schematically, is comprised essentially of, first, a heating unit 1 and a forming unit 2. According to this invention, the conical wire sections are produced by hot forming. This hot forming is preferably carried out at a hot forming temperature of 400° C. to 950° C.

In the embodiment illustrated here, heating unit 1 is an inductive heating unit; thus, the starting material is subjected to an inductive heating here.

When using the method according to this invention, the starting material can be heated to the hot forming temperature. However, there is the possibility of heating the starting material to a temperature above the hot forming temperature; then, after heating the starting material to the hot forming temperature, it is cooled, preferably with air, water or a solution of polymer as the cooling medium. Consequently, the installation according to this invention has a cooling unit 3 between heating unit *and forming unit 2 in the embodiment diagramed here.*

Figure 3:
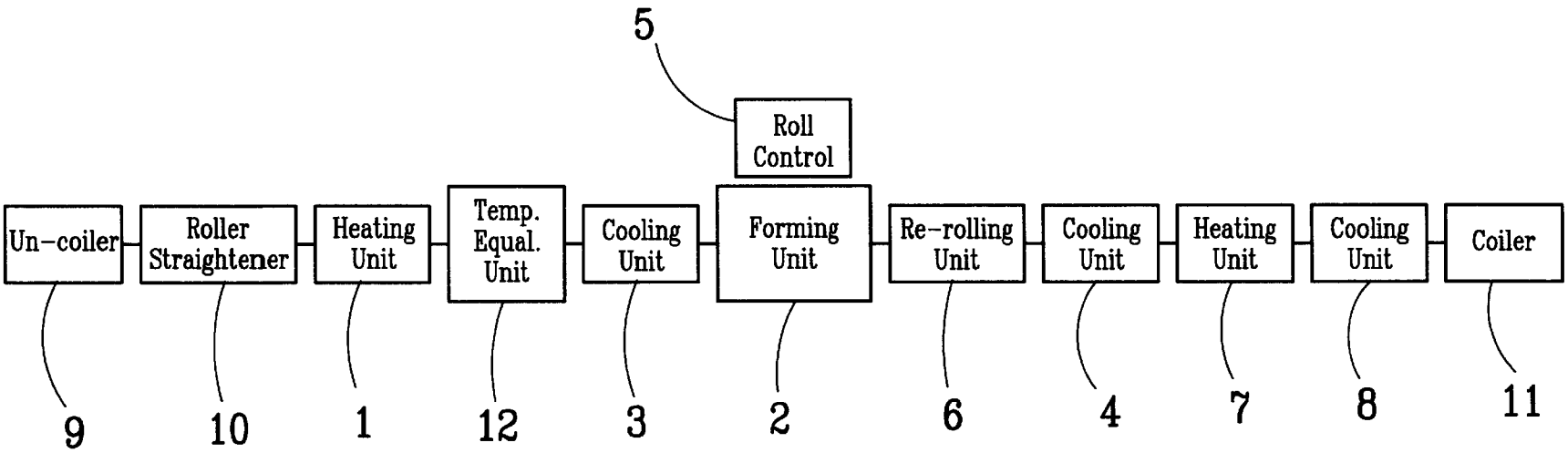

In the installation according to this invention, the heating unit 1 may be provided with a temperature equalization unit, or as shown if FIG. 3, a temperature equalization unit 12 may be provided downstream from heating unit 1. This yields the possibility of subjecting the starting material to a temperature equalization measure, equalizing the temperature over the cross section of the wire, after heating the starting material and before hot forming, preferably by passing the starting material through a temperature equalization unit designed as a thermal insulation tube.

The embodiment shown here of an installation according to this invention is also provided with a cooling unit 4 downstream from the forming unit 2. After hot forming, the biconical wire is cooled, preferably with water, oil or a solution of polymer as a cooling medium.

The properties of the biconical wire manufactured according to this invention can be influenced in a positive sense through the rate of temperature increase in heating the starting material, the temperature to which the starting material is heated, the cooling of the starting material, if any, and the cooling rate and the type of cooling medium, the type of temperature equalization measure and/or cooling of the biconical wire after hot forming, specifically the cooling rate and the cooling medium, and this can be accomplished in conjunction with type of hot forming. In particular, it is possible to achieve an optimized structure.

The forming in the method according to this invention, i.e., implementation of the conical wire sections, is preferably accomplished by rolling. Consequently, forming unit 2 is designed accordingly. Not shown here is the fact that forming unit 2 may have alternately arranged pairs of rolls, preferably offset by 90° relative to each other. As an alternative, however, the forming unit 2 may also be designed as a three-roll skewed-roll mill. At any rate, the rolls, which are not shown, can be advanced toward each other in operation, so the roll gap and thus the dimensions of the rolling stock can be varied in operation.

In the method according to this invention, a deformation-induced strain of between 5% and 100% can be achieved in forming. At relatively high strains, it is advisable to perform the rolling in several reduction passes.

FIG. 2 indicates that the installation according to this invention, in the embodiment shown here, also includes a roll control 5, a re-rolling unit 6 for re-rolling to round off the rolled edges, another heating unit 7 for annealing or tempering, and another cooling unit 8 downstream from the additional heating unit 7.

Finally, the illustrated embodiment of the installation according to this invention also includes an uncoiler 9, a roller straightening apparatus 10 with mangle rolls (not shown) that are arranged in alternation and are offset 90° relative to each other, arranged upstream from the heating unit 1, and a coiler 11 for reeling up the biconical wire produced according to this invention.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. An installation for producing biconical wire from a cylindrical wire comprising a heating unit, a forming unit downstream of said heating unit, said forming unit having means for hot forming of the cylindrical wire to form conical wire sections which alternate with cylindrical wire sections, and a cooling unit provided between the heating unit and the forming unit.

2. An installation according to claim 1, wherein the heating unit is an inductive heating unit.

3. An installation according to claim 1, wherein the heating unit is provided with a temperature equalization unit.

4. An installation according to claim 1, wherein a temperature equalization unit is provided downstream of the heating unit.

5. An installation according to claim 1, wherein the forming unit has roll pairs which are offset relative to each other.

6. An installation according to claim 1, wherein the forming unit comprises a three-roll skewed-roll mill.

7. An installation according to claim 1, wherein the rolls are advanced toward each other in operation.

8. An installation according to claim 1, wherein a roller straightening apparatus is provided upstream from the heating unit.

9. A method of producing bioconical wire comprising the step of hot forming a cylindrical wire to form conical wire sections which alternate with cylindrical wire sections; wherein the hot forming is performed by rolling; and wherein said rolling is carried out in several reduction passes.

10. A method of producing biconical wire comprising the step of hot forming a cylindrical wire to form conical wire sections which alternate with cylindrical wire sections; wherein the hot forming is performed by rolling; and re-rolling said biconical wire after said rolling to round off rolled edges.

11. An installation for producing biconical wire from a cylindrical wire comprising a heating unit and a forming unit downstream of said heating unit, said forming unit having means for hot forming of the cylindrical wire to form conical wire sections which alternate with cylindrical wire sections, and wherein a cooling unit is arranged downstream from the forming unit.

12. An installation for producing biconical wire from a cylindrical wire comprising a heating unit and a forming unit downstream of said heating unit, said forming unit having means for hot forming of the cylindrical wire to form conical wire sections which alternate with cylindrical wire sections, and wherein a re-rolling unit is provided downstream from the forming unit.

13. An installation for producing biconical wire from a cylindrical wire comprising a heating unit and a forming unit downstream of said heating unit, said forming unit having means for hot forming of the cylindrical wire to form conical wire sections which alternate with cylindrical wire sections, and wherein a second heating unit for annealing or tempering of the wire is provided downstream from the forming unit.

14. An installation according to claim 13, wherein a cooling unit is provided downstream from the second heating unit for annealing or tempering of the wire.

15. A method of producing biconical wire comprising the step of hot forming a cylindrical wire to form concial wire sections which alternate with cylindrical wire sections; heating said cylindrical wire to a temperature above the temperature at which the hot forming is performed and cooling said cylindrical wire to a temperature at which hot forming is performed.

16. A method according to claim 15, wherein said hot forming is performed at a hot forming temperature of 400° C. to 950° C.

17. A method according to claim 15, wherein the cylindrical wire to a inductive heating prior to said hot forming.

18. A method according to claim 1, wherein the cooling of the cylindrical wire is performed using air, water or a solution of polymer as a cooling medium.

19. A method according to claim 15, wherein after heating and before hot forming, the cylindrical wire is subjected to temperature equalization.

20. A method according to claim 15, wherein after hot forming, the biconical wire formed is cooled with water, oil or a solution of polymer as a cooling medium.

21. A method according to claim 15, wherein the hot forming is performed by rolling.

22. A method according to claim 15, wherein the cylindrical wire is supplied from an uncoiler and is straightened before heating and hot forming thereof.

23. A method according to claim 15, wherein the biconical wire formed is wound onto a coiler.

24. A method according to claim 21, wherein the rolling is performed by means of pairs of rolls that are offset relative to each other.

25. A method according to claim 21, wherein the rolling is performed with a three-roll skewed-roll mill.

26. A method according to claim 21, wherein the rolls are advanced toward each other during rolling.

27. A method of producing biconical wire comprising the step of hot forming a cylindrical wire to form conical wire sections which alternate with cylindrical wire sections; wherein said hot forming is performed so as to achieve a deformation-induced strain between 5% and 100%.

* * * * *